US006857249B1

(12) United States Patent
Hsu

(10) Patent No.: US 6,857,249 B1
(45) Date of Patent: Feb. 22, 2005

(54) SAFETY CATCH DEVICE OF SEALING MACHINE

(76) Inventor: Che Ting Hsu, 3F, No. 126, Sec. 2, Chung Yang Road, Tu Cheng, Taipei Hsien (TW)

( * ) Notice: Subject to any disclaimer, the term of this patent is extended or adjusted under 35 U.S.C. 154(b) by 38 days.

(21) Appl. No.: 10/637,627

(22) Filed: Aug. 11, 2003

(51) Int. Cl.[7] ..... B65B 57/00
(52) U.S. Cl. ..... 53/77; 200/61.7; 192/130
(58) Field of Search ..... 53/52, 77, 507, 53/508; 200/61.58 R, 61.62, 61.7, 61.71, 61.78, 61.81; 192/129 A, 133, 130

(56) References Cited

U.S. PATENT DOCUMENTS 2,312,243 A * 2/1943 Evans et al. ..... 200/61.76
2,661,689 A * 12/1953 D'Assis Fonseca ..... 244/3.29
3,803,375 A * 4/1974 Foltz ..... 200/61.7
4,479,571 A * 10/1984 Eliot ..... 192/129 A
4,687,889 A * 8/1987 Leger ..... 200/61.62
4,764,648 A * 8/1988 Resh ..... 200/61.62
4,918,266 A * 4/1990 Dalebout et al. ..... 200/61.58 R
5,233,290 A * 8/1993 Swart ..... 200/61.76
5,432,309 A * 7/1995 Takeuchi et al. ..... 200/61.62
5,967,045 A * 10/1999 Staiger et al. ..... 101/366
6,479,772 B2 * 11/2002 Fan ..... 200/61.62

* cited by examiner

*Primary Examiner*—Rinaldi I. Rada
*Assistant Examiner*—Louis Huynh
(74) *Attorney, Agent, or Firm*—Rosenberg, Klein & Lee

(57) ABSTRACT

A safety catch device of a sealing machine has a baffle and a probe set. The baffle is pivotally arranged at the opening of the machine body. A conducting sheet is provided at the rear side of the baffle. The probe set has a first probe and a second probe, which are connected to a circuit unit with signal cables. The front end of the first probe exceeds the front end of the second probe by a certain distance. The front end of the first probe contacts the conducting sheet. The front end of the second probe keeps a certain distance from the conducting sheet. When the baffle swings backwards, the conducting sheet contacts the front end of the second probe to transfer signals to the circuit unit for stopping the film sealing operation. The safety of operation can thus be greatly enhanced to effectively avoid occurrence of hazards.

10 Claims, 6 Drawing Sheets

SAFETY CATCH DEVICE OF SEALING MACHINE

FIELD OF THE INVENTION

The present invention relates to a safety catch device of a sealing machine and, more particularly, to a safety catch device of a sealing machine for greatly enhancing the safety of the cup mouth film sealing operation to effectively avoid occurrence of hazards.

BACKGROUND OF THE INVENTION

Nowadays, when takeout food includes liquid soup or juice, a cup (or bowl) with a lid is used instead of a heatproof plastic bag. After the lid is covered up, although the cup seems airtight, if the cup topples over due to vibration or other factors, the soup or juice will flow out, resulting in a sticky state on the periphery of the cup and thus affecting the appetite. Therefore, a sealing machine has been proposed. As shown in FIGS. 1 and 2, a conventional sealing machine comprises a machine body 10*a*, a cup seat 11*a*, a film reel 12*a* and a waste material reel 13*a*. The cup base 11*a* is arranged on the machine body 10*a*, and can enter or exit an opening in the front side of the machine body 10*a*. The film reel 12*a* and the waste material reel 13*a* are arranged above the machine body 10*a*. A film 20*a* is rolled on the film reel 12*a*, passes through the center of the machine body 10*a*, and then is wound around the waste material reel 13*a*. The waste material reel 13*a* is used to wind waste material and pull the film 20*a* on the film reel 12*a* forwards.

When a cup (or bowl) containing food is placed on the cup seat 11*a*, the film reel 12*a* and the waste material reel 13*a* are simultaneously driven to create rotation at a fixed distance, hence performing the actions of cup mouth film sealing and waste material winding. The cup seat 11*a* is then driven to automatically exit. A push-out device (not shown) is used to butt the film-sealed cup so that a user can take up the cup from the cup seat 11*a*. This sealing machine not only facilitates the automatic film sealing operation, but also exactly seals the cup. Even if the cup topples over, the soup or juice will not flow out.

However, for the above conventional sealing machine, when an object is detected on the cup seat 11*a*, the cup seat 11*a* will be driven to enter the machine body 10*a* to start the operation of cup mouth film sealing. When the power is not cut off, if one places his hand on the cup seat 11*a* or an object is placed on the cup seat 11*a*, the operation of cup mouth film sealing will start to harm the hand or damage the sealing machine.

SUMMARY OF THE INVENTION

The primary object of the present invention is to provide a safety catch device of a sealing machine to greatly enhance the operation safety of the sealing machine and effectively avoid occurrence of hazards.

To achieve the above object, the present invention provides a safety catch device of a sealing machine. The safety catch device is arranged at an opening in the front side of a machine body of the sealing machine. The safety catch device comprises a baffle and a probe set. The baffle is pivotally arranged at the opening of the machine body. A conducting sheet is provided at the rear side of the baffle. The probe set has a first probe and a second probe. The first and second probes are fixed inside the machine body and connected to a circuit unit with signal cables. The front end of the first probe exceeds the front end of the second probe a certain distance. The front end of the first probe contacts the conducting sheet. The front end of the second probe keeps a certain distance from the conducting sheet. When the baffle swings backwards, the conducting sheet contacts the front end of the second probe to transfer signals to the circuit unit for stopping the operation of film sealing.

The present invention provides a safety catch device of a sealing machine. The sealing machine comprises a machine body, a cup seat, a film reel, a waste material reel and a safety catch device. The machine body has an opening in a front side thereof. The cup seat is arranged on the machine body, and can enter and exit the opening. The film reel is arranged above the machine body. The waste material reel is also arranged above the machine body. The safety catch device comprises a baffle and a probe set. The baffle is pivotally arranged at the opening of the machine body. A conducting sheet is provided at the rear side of the baffle. The probe set has a first probe and a second probe. The first and second probes are fixed inside the machine body and connected to a circuit unit with signal cables. The front end of the first probe exceeds the front end of the second probe by a certain distance. The front end of the first probe contacts the conducting sheet. The front end of the second probe keeps a certain distance from the conducting sheet. When said baffle swings backwards, the conducting sheet contacts the front end of the second probe to transfer signals to the circuit unit for stopping the operation of film sealing.

BRIEF DESCRIPTION OF THE DRAWINGS

The various objects and advantages of the present invention will be more readily understood from the following detailed description when read in conjunction with the appended drawing, in which.

DETAILED DESCRIPTION OF THE PREFERRED EMBODIMENTS

Figure 1:
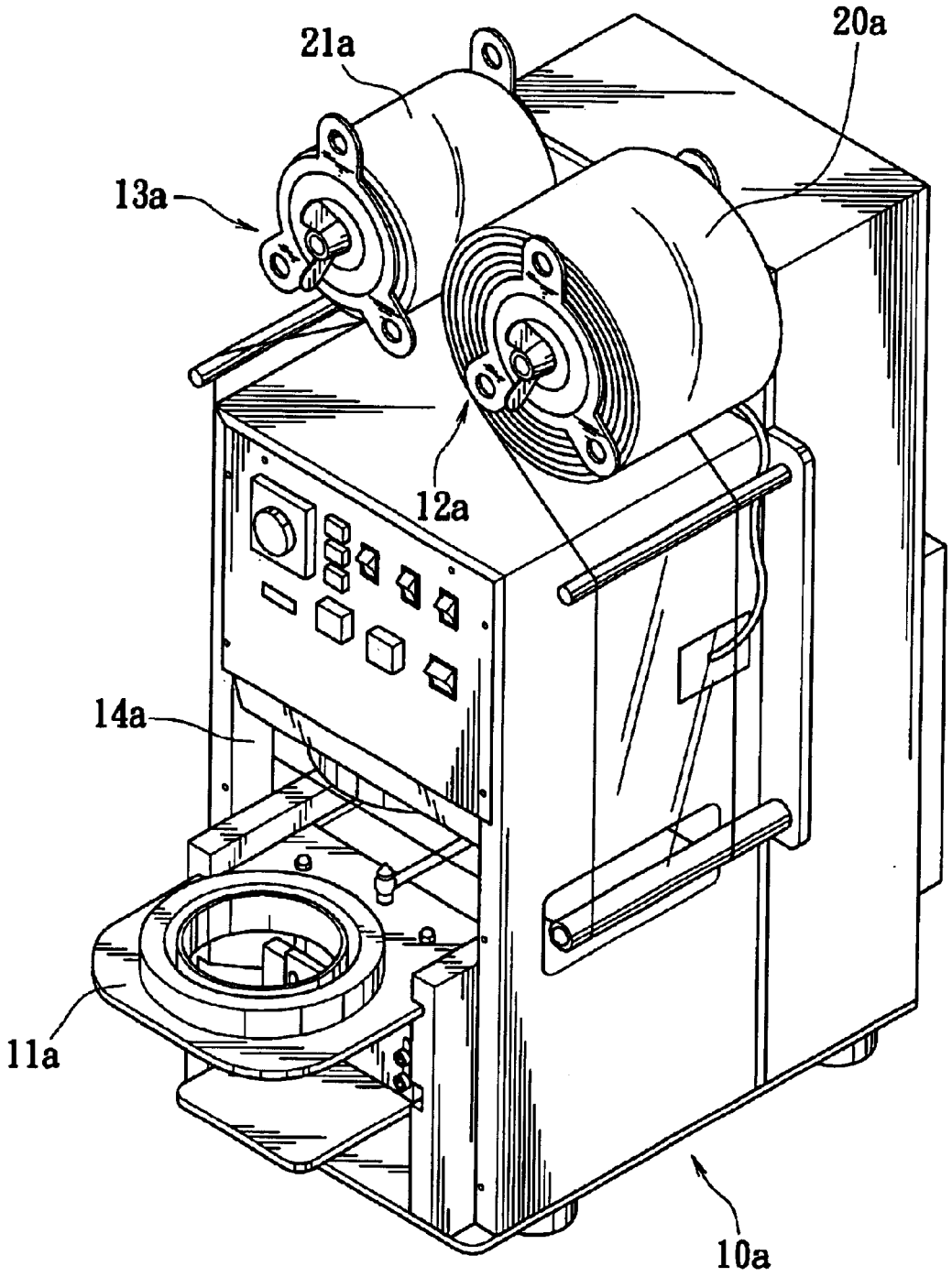
FIG. 1 PRIOR ART
FIG. 1 is a perspective view of a conventional sealing machine.
Figure 2:
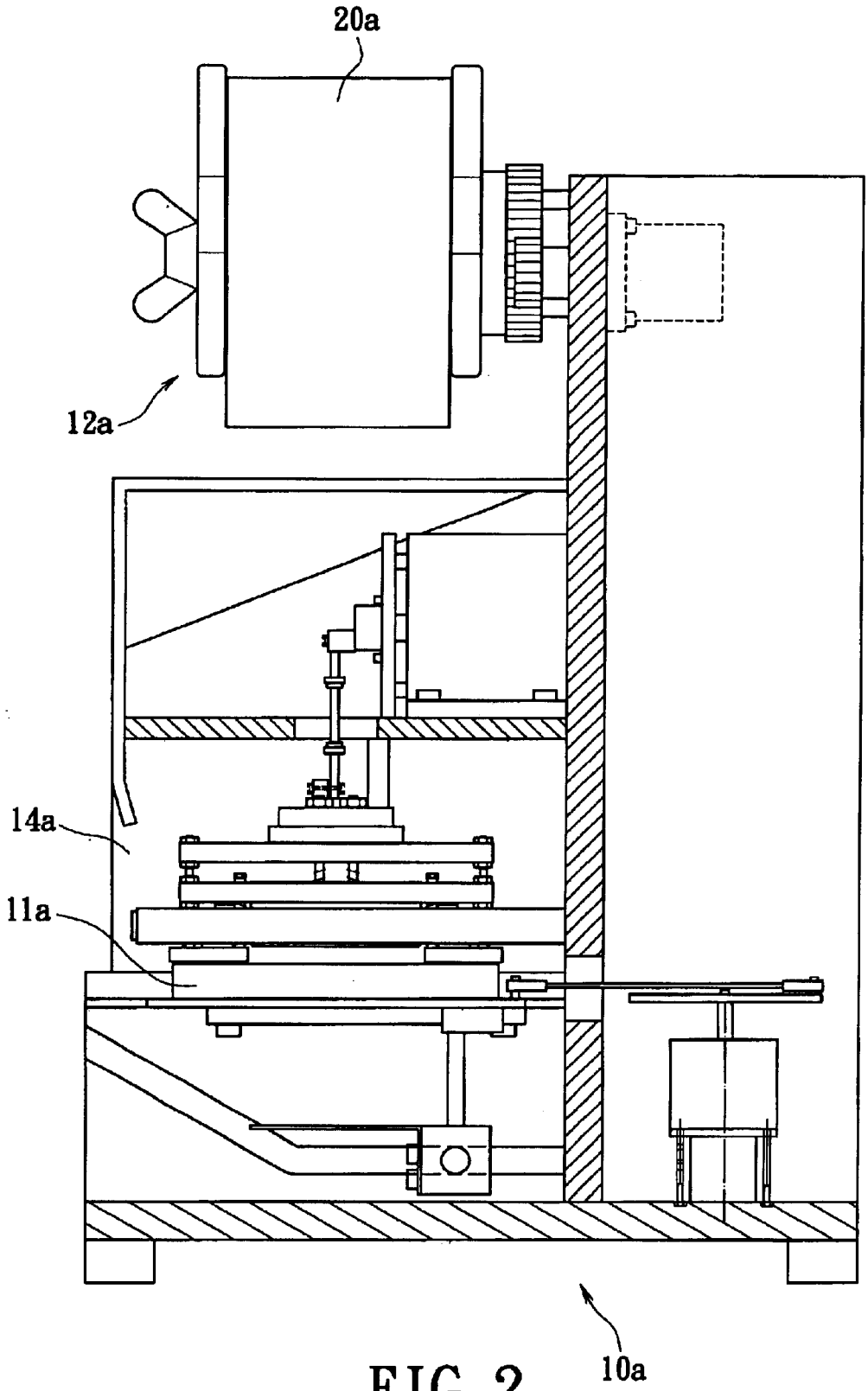
FIG. 2 PRIOR ART
FIG. 2 is a side view of a conventional sealing machine.
Figure 3:
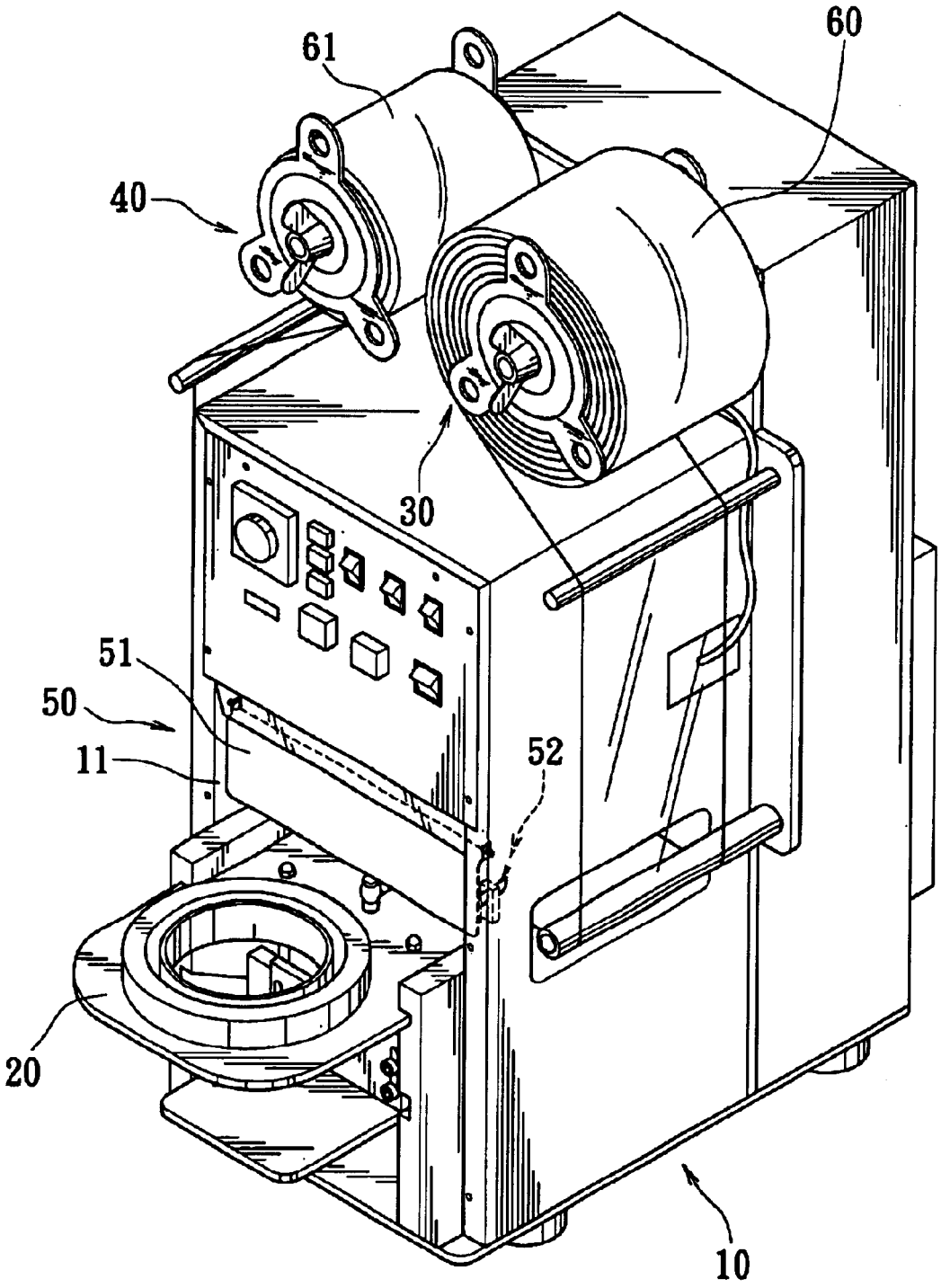
FIG. 3 is a perspective view of a sealing machine of the present invention.
Figure 4:
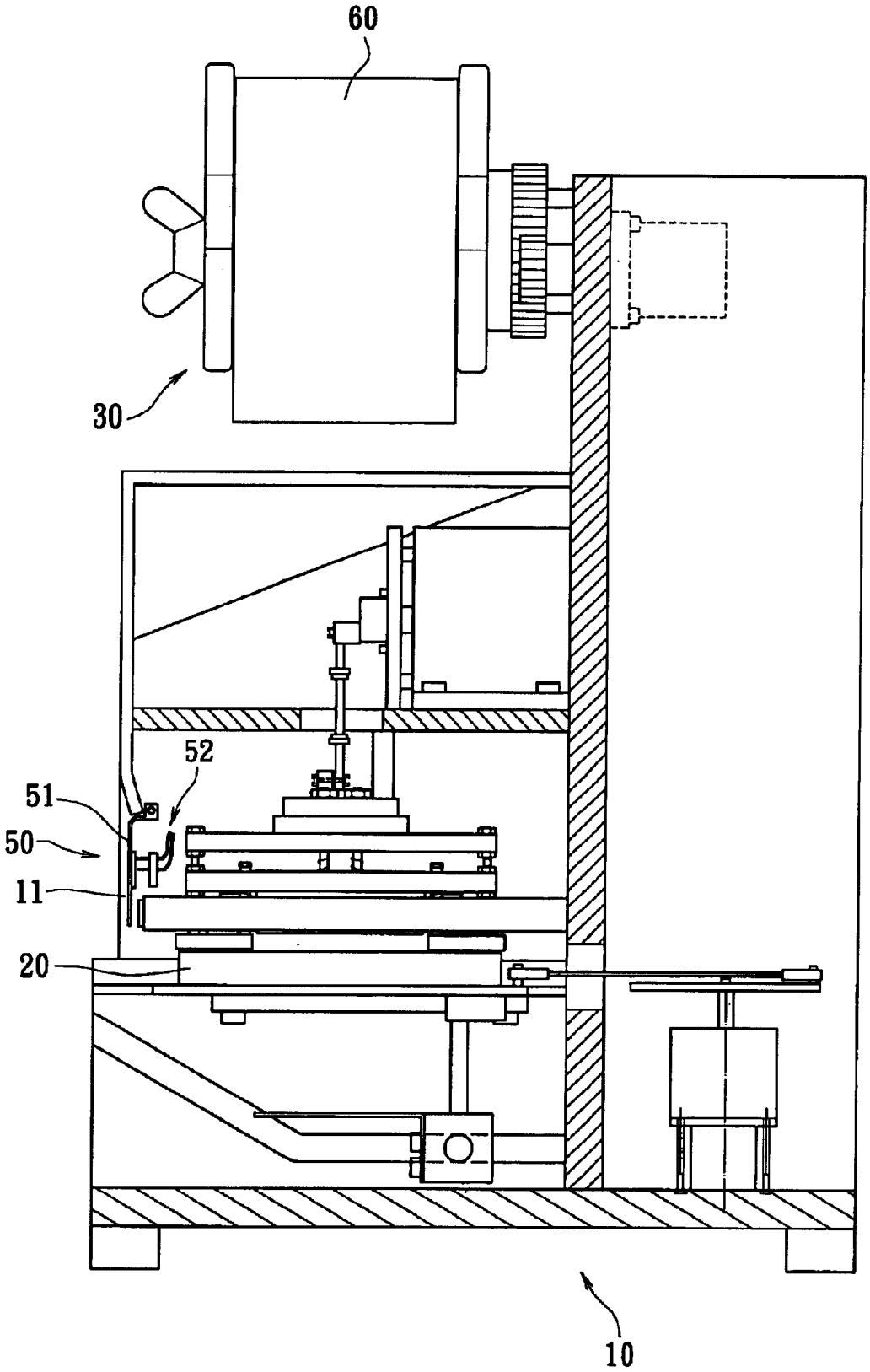
FIG. 4 is a side view of a sealing machine of the present invention.

As shown in FIGS. 3 and 4, the present invention provides a safety catch device of a sealing machine. The sealing machine comprises a machine body 10, a cup seat 20, a film reel 30 and a waste material reel 40. The machine body is a firm and solid architecture, and can be used to support and connect the cup seat 20, the film reel 30 and the waste material reel 40. The machine body 10 has an opening 11 in the front side thereof. The cup seat 20 is arranged on the machine body 10, and can be driven by an appropriate drive mechanism (not shown) to enter or exit the opening 11 in the front side of the machine body 10. The film reel 30 and the waste material reel 40 are arranged above the machine body 10. A film 60 is rolled on the film reel 30, passes through the center of the machine body 10, and is then wound around the waste material reel 40. The waste material reel 40 can be used to wind waste material 61 and pull the film 60 on the film reel 30 forwards.

When a cup (or bowl) containing food is placed inside the cup seat 20, the film reel 30 and the waste material reel 40 are simultaneously driven to rotate at a fixed distance and perform the actions of cup mouth film sealing and waste material winding. The cup seat 20 is driven to exit automatically. A push-out device (not shown) is used to butt the film-sealed cup so that a user can remove the cup from the cup seat 20. Because the structure of the sealing machine is well known in the prior art, it is not further described here.

Figure 5:
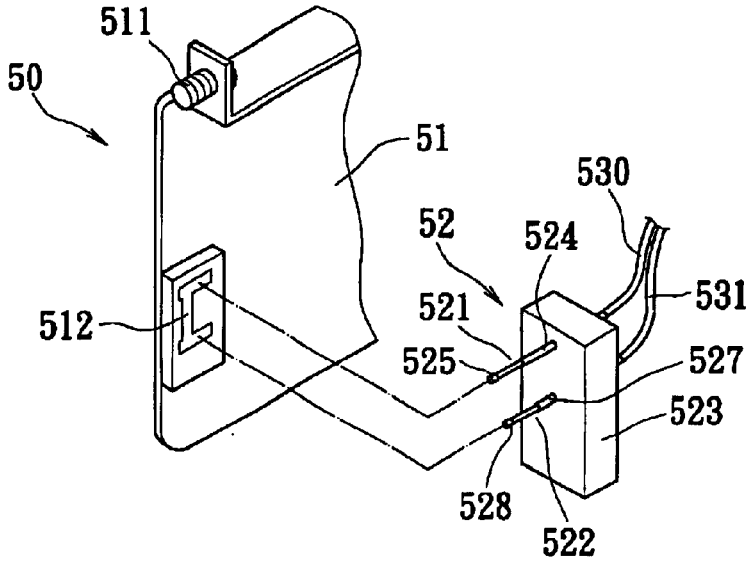
FIG. 5 is a perspective view of a safety catch device of a sealing machine of the present invention.
Figure 6:
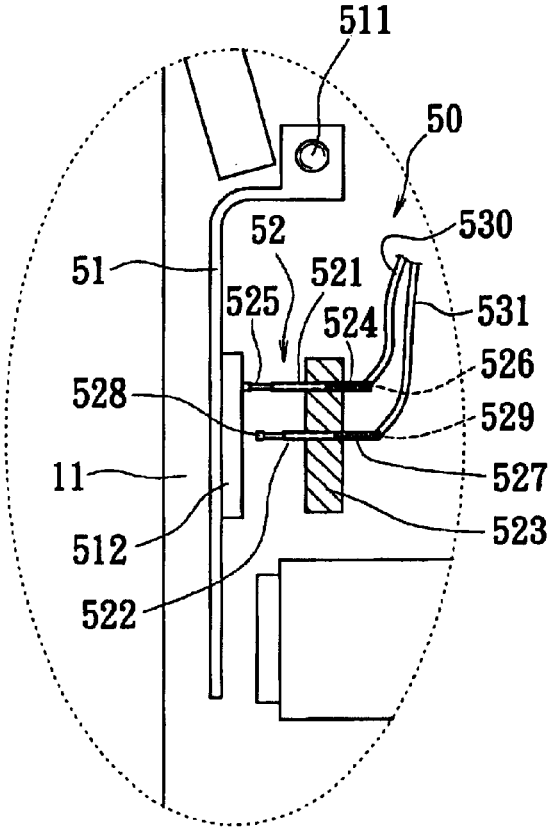
FIG. 6 is a side view of a safety catch device of a sealing machine of the present invention.

Reference is made to FIGS. 5 and 6. A safety catch device 50 is provided at the opening 11 of the machine body 10. The safety catch device 50 comprises a baffle 51 and a probe set 52. The baffle 51 is arranged at the opening 11 of the machine body 10. The upper end of the baffle 51 is pivotally connected above the opening 11 of the machine body 10 with a pivot 511 so that the baffle 51 can be pivotally arranged at the opening 11 of the machine body 10. The baffle 51 can make forward and rearward swings with the pivot 511 as the fulcrum. The lower end of the baffle 51 keeps an appropriate distance from the cup seat 20 to not obstruct the motion of the cup seat 20 after a cup is placed thereon. A conducting sheet 512 made of metal material is fixed provided at the rear side of the baffle 51.

The probe set 52 at least includes two probes. In this embodiment, the probe set 52 has a first probe 521 and a second probe 522. The first and second probes 521 and 522 pass through and are fixed at a fixing base 523. The fixing base 523 is properly fixed inside the machine body 10 so that the first and second probes 521 and 522 can be fixed at an appropriate distance from the rear side of the baffle 51.

The first probe 521 comprises a bushing 524, a contact component 525 and an elastic component 526. The bushing 524 is made of metal material, and is a hollow cylinder. The front end of the bushing 524 is open, while the rear end thereof is closed. The contact component 525 is also made of metal material. The contact component 525 and the elastic component 526 are positioned inside the bushing 524. The elastic component 526 pushes the contact component 525 to let the front end of the contact component 525 protrude out of the front end of the bushing 524.

The structure of the second probe 522 is the same as that of the first probe 521. The second probe 522 comprises a bushing 527, a contact component 528 and an elastic component 529. The bushing 527 is made of metal material, and is a hollow cylinder. The front end of the bushing 527 is open, while the rear end thereof is closed. The contact component 528 is also made of metal material. The contact component 528 and the elastic component 529 are positioned inside the bushing 527. The elastic component 529 pushes the contact component 528 to let the front end of the contact component 528 protrude out of the front end of the bushing 527.

The first and second probes 521 and 522 pass through and are fixed at the fixing base 523 with the bushings 524 and 527, respectively. The bushings 524 and 527 of the first and second probes 521 and 522 are respectively connected with signal cables 530 and 531, and are connected to a circuit unit (not shown) with the signal cables 530 and 531. The contact components 525 and 528 of the first and second probes 521 and 522 protrude out of the fixing base 523 a predetermined distance. The second probe 522 is located below the first probe 521. The front end of the contact component 525 of the first probe 521 exceeds the front end of the contact component 528 of the second probe 522 by a certain distance.

The front end of the contact component 525 of the first probe 521 will normally abut the conducting sheet 512 at the rear side of the baffle 51 to let the baffle 51 have an appropriate resistance force and not swing rearwards due to wind or vibration. The contact component 528 of the second probe 522 keeps a certain distance from the conducting sheet 512 to let electric connection be not accomplished between the first probe 521 and the second probe 522 so that signals for stopping the operation of cup mouth film sealing can't be transferred to the circuit unit. Therefore, the operation of cup mouth film sealing can be normally performed. Because there is still a predetermined distance between the lower end of the baffle 51 and the cup seat 20, when a cup is placed on the cup seat 20 and the cup seat is driven to move into the opening 11, the cup does not touch the baffle 51 so that the operation of cup mouth film sealing can be successfully performed.

Figure 7:
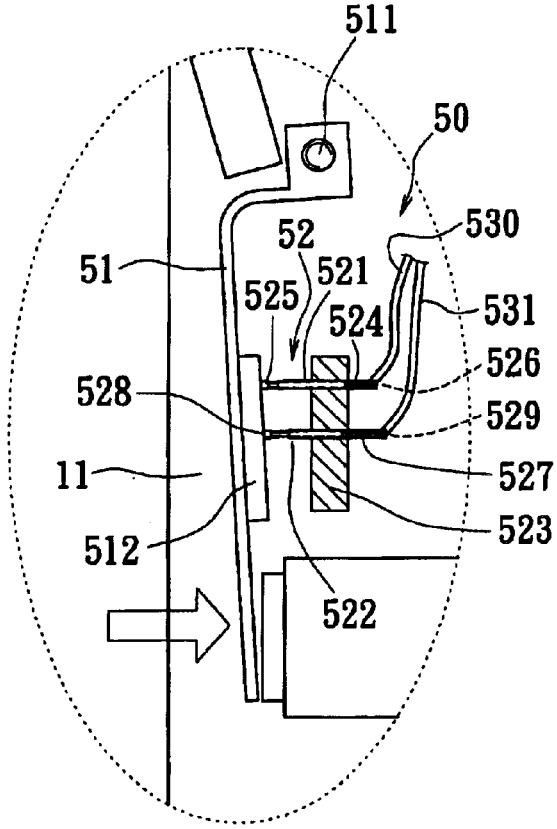
FIG. 7 is an action diagram of a safety catch device of a sealing machine of the present invention.

After a user places a cup on the cup seat 20, if his hand still rests on the cup seat 20 or there is another foreign object placed on the cup seat 20, when the cup seat 20 is driven to move from the opening 11 into the machine body 10, the hand or the foreign object will contact the baffle 51 to make the baffle 51 swings backwards (inwards) with the pivot 511 as the fulcrum. The conducting sheet 512 at the rear side of the baffle 51 will contact the front end of the contact component 528 of the second probe 522 (FIG. 7) so that electric connection is accomplished between the first and second probes 521 and 522 through the conducting sheet 512. Signals can thus be transferred to the circuit unit to stop the operation of cup mouth film sealing. After the problem has been troubleshot, the operation of cup mouth film sealing can start again. The safety catch device of the present invention can thus greatly enhance the operation safety of the sealing machine and effectively avoid hazards.

Figure 8:
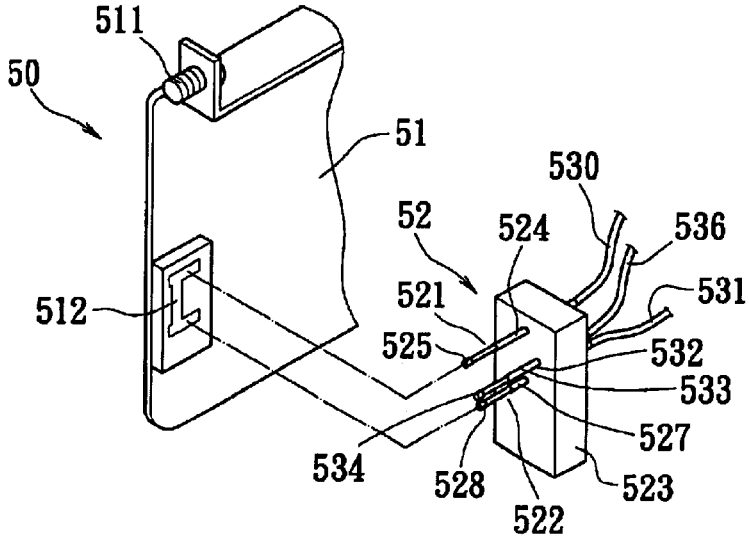
FIG. 8 is a perspective view of a safety catch device of a sealing machine according to another embodiment of the present invention.
Figure 9:
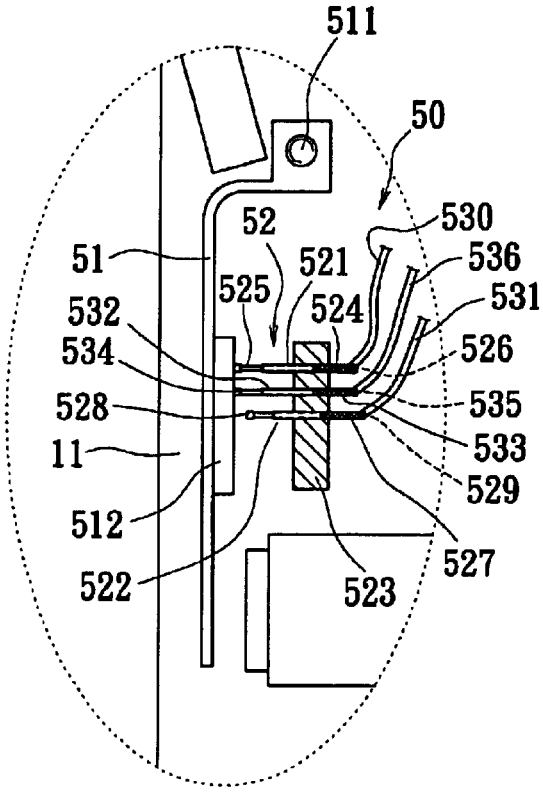
FIG. 9 is a side view of a safety catch device of a sealing machine according to another embodiment of the present invention.

Besides, as shown in FIGS. 8 and 9, the probe set 52 can further has a third probe 53, which comprises a bushing 533, a contact component 534 and an elastic component 535.

Because the structure of the third probe 532 is the same as that of the first probe 521 or the second probe 522, it is not further described here. The bushing 533 of the third probe 532 is connected to the circuit unit with a signal cable 536. The third probe 532 is located between the first and second probes 521 and 522. The front end of the contact component 534 of the third probe 532 aligns with the front end of the contact component 525 of the first probe 521.

The front ends of the contact components 525 and 534 of the first and third probes 521 and 532 will normally abut against the conducting sheet 512 at the rear side of the baffle 51 to let the baffle 51 have an appropriate resistance force and not swing rearwards due to wind or vibration. The contact component 528 of the second probe 522 keeps a certain distance from the conducting sheet 512 to prevent electric connection between the first and second probes 521 and 522 so that signals for stopping the operation of cup mouth film sealing cannot be transferred to the circuit unit. Therefore, the operation of cup mouth film sealing can normally proceed.

After a user places a cup on the cup seat 20, if his hand still rests on the cup seat 20 or there is another foreign object placed on the cup seat 20, when the cup seat 20 is driven to move from the opening 11 into the machine body 10, the hand or the foreign object will contact the baffle 51 to make the baffle 51 swings backwards (inwards) with the pivot 511 as the fulcrum. The conducting sheet 512 at the rear side of the baffle 51 will contact the front end of the contact component 528 of the second probe 522 (FIG. 7) so that electric connection is accomplished between the first, second and third probes 521, 522 and 532 through the conducting sheet 512. Signals can thus be transferred to the circuit unit to stop the operation of cup mouth film sealing.

Figure 10:
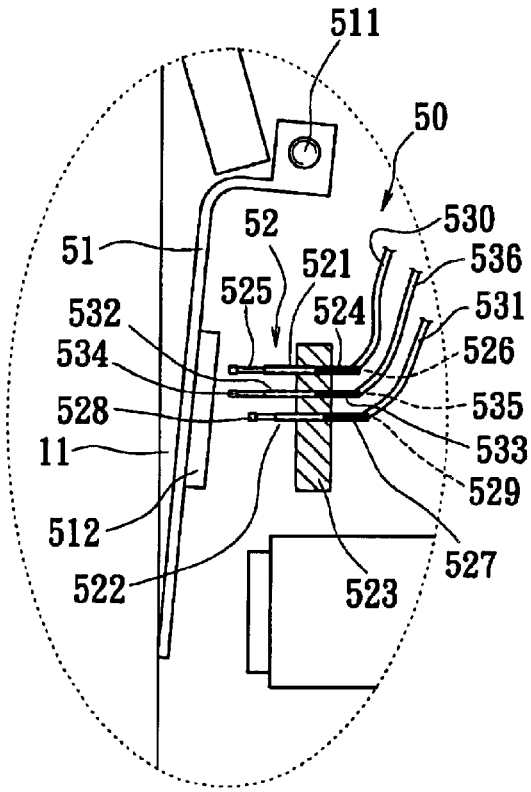
FIG. 10 is an action diagram of a safety catch device of a sealing machine according to another embodiment of the present invention.

As shown in FIG. 10, when the baffle 51 swings forwards (outwards) with the pivot 511 with the fulcrum, the conducting sheet 512 at the rear side of the baffle 51 will immediately come off the front ends of the contact components 525 and 534 of the first and third probes 521 and 532 to prevent electric connection between the first and third probes 521 and 532. Signals thus can also be transferred to the circuit unit to stop the operation of cup mouth film sealing. Since operation of cup mouth film sealing can also be stopped when the baffle 51 swings forwards, the operation safety of the sealing machine can be greatly enhanced.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. A safety catch device for stopping a film sealing operation of a sealing machine, said safety catch device being arranged at an opening in the front side of a machine body of said sealing machine, said safety catch device comprising:

a baffle pivotally provided at the opening of said machine body, a conducting sheet being provided at a rear side of said baffle; and a probe set having a first probe and a second probe, said first and second probes being fixed inside said machine body and connected to a circuit unit with signal cables, wherein a front end of said first probe exceeds a front end of said second probe by a certain distance, the front end of said first probe contacts said conducting sheet and the front end of said second probe keeps a certain distance from said conducting sheet;

whereby said conducting sheet contacts the front end of said second probe to transfer signals to said circuit unit for stopping the operation of film sealing when said baffle swings backwards.

2. The safety catch device of a sealing machine as claimed in claim 1, wherein an upper end of said baffle is pivotally connected above the opening of said machine body with a pivot.

3. The safety catch device of a sealing machine as claimed in claim 1, wherein each of said first and second probes comprises a bushing, a contact component and an elastic component, said contact component and said elastic component are positioned in said bushing, said elastic component pushes the front end of said contact component to protrude out of a front end of said bushing, said first and second probes pass through and are fixed at a fixing seat using said bushings, said fixing seat is fixed in said machine body, said first and second probes are connected with said signal cables using said bushings, a front end of said contact component of said first probe exceeds a front end of said contact component of said second probe by a certain distance and the front end of said contact component of said first probe contacts said conducting sheet.

4. The safety catch device of a sealing machine as claimed in claim 1, wherein said second probe is located below said first probe.

5. The safety catch device of a sealing machine as claimed in claim 1, wherein said probe set has also a third probe fixed in said machine body, said third probe is connected to said circuit unit with another signal cable, said third probe is located between said first and second probes, a front end of said third probe aligns with the front end of said first probe, the front end of said third probe also contacts said conducting sheet, and said contact sheet comes off the front ends of said first and third probes to transfer signals to said circuit unit for stopping the film sealing operation when said baffle swings forwards.

6. A safety catch device for stopping a film sealing operation of a sealing machine, said sealing machine comprising:

a machine body having an opening in a front side thereof;

a cup seat arranged on said machine body and capable of entering and exiting said opening;

a film reel arranged above said machine body;

a waste material reel arranged above said machine body; and a safety catch device comprising a baffle and a probe set, said baffle being pivotally arranged at said opening of said machine body, a conducting sheet being provided at a rear side of said baffle, said probe set having a first probe and a second probe, said first and second probes being fixed inside said machine body and connected to a circuit unit with signal cables, a front end of said first probe exceeds a front end of said second probe by a certain distance, the front end of said first probe contacts said conducting sheet and the front end of said second probe keeping a certain distance from said conducting sheet;

whereby said conducting sheet contacts the front end of said second probe to transfer signals to said circuit unit for stopping the operation of film sealing when said baffle swings backwards.

7. The safety catch device of a sealing machine as claimed in claim 6, wherein an upper end of said baffle is pivotally connected above said opening of said machine body with a pivot.

8. The safety catch device of a sealing machine as claimed in claim 6, wherein each of said first and second probes comprises a bushing, a contact component and an elastic component, said contact component and said elastic component are positioned in said bushing, said elastic component pushes a front end of said contact component to protrude out of a front end of said bushing, said first and second probes pass through and are fixed at a fixing seat using said bushings, said fixing seat is fixed in said machine body, said first and second probes are connected with said signal cables using said bushings, the front end of said contact component of said first probe exceeds the front end of said contact component of said second probe by a certain distance and the front end of said contact component of said first probe contacts said conducting sheet.

9. The safety catch device of a sealing machine as claimed in claim 6, wherein said second probe is located below said first probe.

10. The safety catch device of a sealing machine as claimed in claim 6, wherein said probe set has also a third probe fixed in said machine body, said third probe is connected to said circuit unit with another signal cable, said third probe is located between said first and second probes, the front end of said third probe aligns with the front end of said first probe, the front end of said third probe also contacts said conducting sheet and said contact sheet comes off the front ends of said first and third probes to transfer signals to said circuit unit for stopping the film sealing operation when said baffle swings forwards.

* * * * *